United States Patent [19]
Tsao et al.
[11] 4,266,981
[45] May 12, 1981

[54] PROCESS FOR RECOVERING AND UTILIZING CELLULOSE USING SULFURIC ACID

[75] Inventors: George T. Tsao; Terry Y. Chou, both of West Lafayette, Ind.

[73] Assignee: Purdue Research Corporation, West Lafayette, Ind.

[21] Appl. No.: 81,538

[22] Filed: Oct. 3, 1979

[51] Int. Cl.[3] ..... C13K 1/02
[52] U.S. Cl. ..... 127/37; 162/76; 162/82; 435/99
[58] Field of Search ..... 127/37; 435/99; 162/76, 162/82

[56] References Cited

U.S. PATENT DOCUMENTS

| | | | |
|---|---|---|---|
| 2,302,022 | 11/1942 | Giordani | 127/37 |
| 2,465,347 | 3/1949 | Boehm | 127/37 |
| 3,212,933 | 10/1965 | Hess | 127/37 |
| 3,972,775 | 8/1976 | Wilke | 435/99 |

*Primary Examiner*—Sidney Marantz
*Attorney, Agent, or Firm*—John R. Nesbitt; Robert E. Harris

[57] ABSTRACT

A process for recovering cellulose using sulfuric acid and utilizing the recovered cellulose by hydrolysis to yield glucose. Cellulosic raw materials are hydrolyzed by dilute sulfuric acid to remove hemicellulose, after which the solid residue is separated and is treated with concentrated sulfuric acid to dissolve cellulose contained therein. After blending and mixing of the residue in the concentrated sulfuric acid under mild reaction conditions, cellulose is reprecipitated by addition of water or an organic solvent such as methanol. The recovered cellulose can then be hydrolyzed by cellulose enzymes and/or dilute acids to provide a high yield of glucose. High level recovery and reconcentration of the sulfuric acid is also disclosed.

19 Claims, No Drawings

PROCESS FOR RECOVERING AND UTILIZING CELLULOSE USING SULFURIC ACID

RELATED APPLICATION

This application is a continuation of Ser. No. 884,480 filed Nov. 8, 1978, now abandoned.

FIELD OF THE INVENTION

This invention relates to a process for recovery of cellulose and, more particularly, to a process for recovery and utilization of cellulose utilizing concentrated sulfuric acid as a hydrolytic solvent for the cellulose. As used herein, the term "hydrolytic solvent" is meant to describe a solvent which effects a partial hydrolysis as well as a solvating action on the cellulose.

BACKGROUND OF THE INVENTION

The utilization of cellulosic waste materials, such as cornstalks, sawdusts, straws, bagasse, and the like, has been the subject of strong interest recently, particularly with respect to utilization of such waste materials for developing alternate sources of fuels, feedstuffs, chemicals and other useful products.

Cellulosic materials include three principal components—cellulose, hemicellulose and lignin. Methods for extraction of hemicellulose have heretofore been suggested and/or utilized and such extracted hemicellulose can be utilized by many existing methods including hydrolysis, fermentation, pyrolysis, and the like.

Lignin has also been isolated from cellulosic materials and since it is higher in hydrogen and carbon and lower in oxygen content than cellulose and hemicellulose it has the highest fuel utility of the three. Isolated lignin can be burned to generate steam and electricity and can also be used to produce a number of useful products including vanillin, dimethylsulfoxide, dimethyl sulfide, and methyl mercaptan and catechol.

Recovery of cellulose and/or utilization of the same, as by hydrolysis to provide glucose, has presented a problem heretofore primarily due to the crystalline structure of the cellulose molecules and the presence therein of a lignin seal.

Attempts have been made to hydrolyze cellulose, and these attempts have included the use of acids or enzymes, but such attempts have not been completely successful, at least not in providing an economically attractive method that is capable of providing a satisfactorily high yield of glucose for the cellulose in such cellulosic materials.

The use of acids including sulfuric acid in hydrolysis of cellulosic materials to produce glucose has been known for many decades. In general, all previously reported processes of cellulose hydrolysis using sulfuric acid can be classified into two large groups; those using dilute sulfuric acid and those using concentrated sulfuric acid. The dilute acid processes typically involve a sulfuric acid solution containing somewhere from 5 to 50 grams of $H_2SO_4$ in a kilogram of aqueous solution. At a temperature of somewhere from 100° C. to 350° C., cellulosic materials such as wood chips suspended in the dilute acid will be hydrolyzed to produce glucose from cellulose and five carbon sugars from hemicellulose. Since the reaction temperature is usually above the boiling point of the dilute acid, the hydrolysis reaction has to be carried out in pressurized reactors. At a high temperature, glucose and five carbon sugars will also be catalyzed by the acid to form furfural and its derivatives which often react further to form undesirable by-products. The dilute acid processes have thus not been generally successful in obtaining glucose from cellulose in high yields and at low costs. Typically, a dilute acid process gives a glucose yield of about 50% or less based upon available cellulose, hampered by the formation of useless by-products. The dilute acid processes have been well known and extensively studied by many researchers.

There are also a number of reports on processes of cellulose hydrolysis using concentrated sulfuric acid. For instance, there is a relatively recent report by Bose et al. (See Bharati Bose, T. R. Ingle and J. L. Bose, "Saccharification of Groundnut Shell Pulp with Sulfuric Acid", Indian Journal of Technology, Vol. II, September 1973, Pages 391–393) and an earlier report by Dunning and Lathrop (See J. W. Dunning and E. C. Lathrop, "The Saccharification of Agricultural Residue", Industrial and Engineering Chemistry, Vol. 37, 1945, Pages 24–29). In general, these processes involve adding concentrated sulfuric acid containing typically 750 grams of $H_2SO_4$ in a kilogram of acid to a finely divided cellulosic material. After soaking and much blending and mixing, 8 to 10 volumes of water is added to dilute the acid. The mixture is then refluxed for a few hours at atmospheric pressure to produce glucose. Typically, 90% to 93% yield of glucose based upon available cellulose can be obtained by this method without much byproduct formation. The previously reported concentrated sulfuric acid processes, however, suffer from the fact that a large amount of acid is used. After the completion of the hydrolysis, both the acid and the glucose are dissolved in the same aqueous solution. An equally large amount of alkali (usually lime) must then be utilized to neutralize the acid before the sugars can be utilized as, for example, a carbon source in a yeast fermentation. In these processes, the problem of disposal of a large amount of calcium sulfate as a by-product must be faced in addition to the high costs for purchasing both the acid and the alkali.

SUMMARY OF THE INVENTION

This invention provides an improved process for recovering cellulose from cellulosic materials utilizing sulfuric acid, whereafter the recovered cellulose may be hydrolyzed to yield glucose. The process includes hydrolyzing a cellulosic material in two stages; first with dilute acid to hydrolyze the hemicellulose portion of the cellulosic material to a liquid hydrolysate containing principally $C_5$ sugars, and then, after separating the liquid hydrolysate from the first stage hydrolysis from the solid residue containing principally cellulose and lignin, with a relatively small amount of concentrated sulfuric acid to dissolve and partially hydrolyze the cellulose portion of the residue. The dissolved and partially hydrolyzed cellulose may then be separated from the lignin which remains as a solid residue after the concentrated sulfuric acid treatment. The dissolved cellulose is then reprecipitated by diluting the solution thereof with water, or, preferably, by the addition of a water soluble organic solvent such as methanol to extract the concentrated acid. The sulfuric acid mother liquor may be recovered for recycle, and the reprecipitated cellulose, which may be derivatized to a considerable degree, is hydrolyzed with either cellulase enzymes, or dilute acids or combinations of enzymes and acids to provide a high yield of glucose.

In an alternative embodiment, the dissolved cellulose can be reprecipitated and hydrolyzed to glucose in the presence of the solid lignin residue, whereafter the solid lignin can be separated by filtration, centrifugation or the like from the glucose. Since the solid lignin residue is not present in the form a hydrophobic, difficultly penetrable lignin seal, its presence does not adversely effect the hydrolysis of the reprecipitated cellulose to glucose.

It is therefore an object of this invention to provide an improved process for recovering cellulose utlilizing sulfuric acid.

It is another object of this invention to provide an improved process for recovering cellulose which includes hydrolyzing cellulosic materials with dilute acid to disrupt their structure, removing hemicellulose, separating solid material therefrom, and adding relatively small amounts of concentrated acid to dissolve cellulose in the solid material, after which the cellulose is reprecipitated by addition of water or, preferably a water soluble organic solvent such as methanol to the concentrated acid.

It is still another object of this invention to provide an improved process for recovering cellulose and hydrolyzing the same to yield glucose.

It is still another object of this invention to provide an improved process for yielding glucose from cellulose recovered through use of sulfuric acid.

With these and other objects in view which will become apparent to one skilled in the art as the description proceeds, this invention resides in the novel method substantially as hereinafter described, and more particularly defined by the appended Claims, it being understood that such changes in the precise embodiment of the herein disclosed invention are meant to be included as coming within the scope of the claims.

DESCRIPTION OF THE INVENTION

This invention provides an improved process utilizing sulfuric acid for recovering cellulose from available cellulosic materials with much of the acid recovered for recycle and thus enabling a low chemical cost. A high yield of glucose is obtained from the recovered cellulose by hydrolyzing the cellulose with cellulase enzymes and/or dilute acids.

In the process of this invention, a cellulosic raw material, such as corn stover, is first hydrolyzed with either fresh or recycled dilute sulfuric acid under mild conditions to hydrolyze hemicellulose to primarily fermentable sugars. This step involves well known reaction conditions (typically 0.5–5% $H_2SO_4$ at about 90°–140° C. for about 50 minutes to about 8 hours). The liquid hemicellulose hydrolysate is separated from the solid residue, for example, by filtration or centrifugation. The solid residue is then contacted under mild conditions, for example, at about room temperature for a period of up to about one hour, with a hydrolytic solvent which dissolves and thereby decrystallizes and also partially hydrolyzes the cellulose contained in the solid residue. A particularly suitable hydrolytic solvent for use in the process of this invention is sulfuric acid having an acid strength of between about 60 and about 90% by weight, preferably about 75% by weight. When sulfuric acid of the above strength is used as the hydrolytic solvent, it should be used in an amount equal to about 0.2 to about 5 ml/gm of solid residue. After the cellulose in the solid residue has been dissolved, decrystallized and partially hydrolyzed by the concentrated sulfuric acid, the reaction mass is contacted with from about 0.5 to about 5 ml of a reprecipitating agent per ml of added concentrated sulfuric acid to reprecipitate the cellulose in a substantially decrystallized or amorphous form. The reprecipitating agent may comprise water, but it will be appreciated that the use of water will increase the burden on any acid recovery system used to regenerate sulfuric acid for recycle. Accordingly, while water may be used as the reprecipitating agent, use of a water soluble organic solvent such as methanol, ethanol, acetone or the like to extract the concentrated acid and thereby cause reprecipitation is preferred. The reprecipitated amorphous cellulose, which may be derivatized to a considerable degree, is then separated from the liquor containing the sulfuric acid and reprecipitating agent, for example, by filtration, pressing or centrifugation. The amorphous cellulose filter cake is then washed lightly, preferably with a non-aqueous solvent medium such as methanol, ethanol, acetone or the like to remove excess residual acid. The washing step may be performed using water as the wash liquor, however the reprecipitated cellulose is soluble in water to the extent of up to about 20%. Accordingly, this amount of cellulose would be lost to waste if a water wash were employed.

The washed reprecipitated amorphous cellulose is then hydrolyzed to glucose, preferably within a few hours of the reprecipitation step, using either the acid trapped in the wet cake (after suitable dilution with water) or an added enzyme (with proper pH adjustment) as the hydrolytic agent. The hydrolysis of the amorphous cellulose to glucose can be accomplished under mild conditions (about 90°–150° C. for acid hydrolysis and about 40°–60°C. for enzyme hydrolysis) with essentially no degradation of glucose to furfural derivatives because of a manyfold increased susceptibility to hydrolysis of the repricipitated cellulose, as compared to the structured, crystalline cellulose in the crude cellulosic material. The resulting cellulose hydrolysate, comprising essentially glucose, is then separated from the solid lignin-containing residue.

Close control of the reaction conditions as outlined above is important and is the key to successful recovery of sulfuric acid and effective hydrolysis of the reprecipitated amorphous cellulose to yield glucose. If, for example, the reaction time is too long, cellulose molecules may be hydrolyzed too far and a large portion of the cellulose becomes solubilized since cellodextrins of DP (degree of polymerization) less than 7 are soluble in water. When this occurs, that portion of the cellulose is lost because there is no easy and inexpensive way of separating soluble sugars from sulfuric acid. It is believed that this is the main reason that makes known concentrated sulfuric acid processes of cellulose hydrolysis unworkable due to the large expense for the acid and also an alkali to neutralize the acid in order to make a good use of the soluble sugars.

In this invention, with properly controlled mild reaction conditions when the cellulose-lignin mixture is blended and tumbled together with a concentrated sulfuric acid, it has been found that 97% or so by weight of the initial crystalline cellulose will be in a solid decrystallized or amorphouse form after addition of from about 0.5 to about 5 ml per ml of concentrated sulfuric acid of water as the reprecipitating agent to the mixture upon the completion of the blending and tumbling. If a water soluble organic solvent such as methanol, ethanol or acetone is added instead of water, even a higher percentage (i.e. larger than 97% or so) of the initial cellulose will be reprecipitated in the amorphous form.

As indicated above, immediately after the addition of the reprecipitating agent the entire mixture is filtered, centrifuged or pressed to recover some 90% or more of the diluted sulfuric acid. This recovered acid can then be reconcentrated, for example, in an evaporator to remove excess water or the added solvent, thus allowing the acid to be recycled to the process. The filter, centrifuge, or press cake, when washed with water, also generates a dilute acid which can be recycled to the first stage hemicellulose hydrolysis step.

The reprecipitated cellulose, even though in a solid form, has been partially hydrolyzed by the action of the concentrated sulfuric acid to a lower DP than it originally had, and has had its internal structures and lignin seals totally disrupted. Accordingly, the reprecipitated cellulose can be readily and completely hydrolyzed to glucose by a dilute acid and/or by cellulase enzymes after pH adjustment.

As can be appreciated from the foregoing, the process of this invention takes advantage of the fact that before becoming overly hydrolyzed so as to become soluble, cellulose molecules can be reprecipitated in a decrystallized form from a concentrated sulfuric acid solution by dilution with water, or a water soluble organic solvent, and that the reprecipitated cellulose can be readily and substantially completely hydrolyzed by enzymes and/or dilute acids to glucose.

The following examples are illustrative of the invention:

EXAMPLE 1

One milliliter 70% sulfuric acid is occasionally stirred with 0.4 gram Avicel (microcrystalline cellulose from FMC Corp. Type PH101) for half an hour at room temperature. The mixture is then diluted with 3 ml $CH_3OH$ (99% reagent grade) to reprecipitate the cellulose in amorphous form. The mixture is filtered. There is 0.3% sugar loss in the filtrate. (As determined by the well known Anthrone method.) The mixture is then washed with water until slightly acidic, whereafter 3.6 milligrams of this pretreated amorphous cellulose is hydrolyzed at 50° C. with added 0.4 milliliter $NaCH_3COO$ PH=5 buffer solution and 0.04 milliliter cellulase enzyme. The hydrolysis results in 90% conversion of the cellulose to glucose in the first three hours.

EXAMPLE 2

The procedure and reagents are the same as Example 1, except 4 ml $H_2O$ is used to dilute the acid mixture instead of 3 ml $CH_3OH$. The sugar loss in the filtrate is 7.8% and the solid residue has the same accessibility to enzyme as in Example 1.

EXAMPLE 3

Preparation of Lignocellulose

Corn residue (10 grams; mesh size larger than 40) is blended in 500 milliliters of 1 normal sulfuric acid solution. It is heated up in a two liter beaker equipped with a condenser, then mildly boiled for one hour. The resulting mixture is filtered to remove the hemicellulose hydrolysate and is first washed with one liter hot water in a glass filter, then washed with acetone until all color is washed out. The washed residue is transferred onto a piece of aluminum foil and is air dried overnight.

EXAMPLE 4

To 0.1 gm the lignocellulose prepared in accordance with Example 3, there is added 0.6 ml of 65% $H_2SO_4$. The mixture is subjected to the same procedure as Example 1, except that it is diluted with 2 milliliter $CH_3OH$. There is 1.03% sugar loss in the filtrate, and 90% cellulose conversion can be achieved within ten hours.

EXAMPLE 5

One milliliter 70% $H_2SO_4$ is mixed with 0.2 gm of lignocellulose prepared in accordance with Example 3 for one-half hour at room temperature; the mixture is then contacted with 3 ml ethanol (reagent grade) to reprecipitate the cellulose in an amorphous form. The amorphous cellulose is filtered from the mother liquor and is washed with 3 ml additional ethanol. The residual wet cake, still containing a minor amount of trapped acid, is diluted with 6 ml of water and is heated at 95° to 100° C. In less than 3 hours, 90% conversion of the amorphous cellulose to glucose is achieved.

Although certain preferred embodiments of the invention have been disclosed for purpose of illustration, it will be evident that various changes and modification may be made therein without departing from the scope and spirit of the invention set forth in the following claims:

What is claimed is:

1. A process for recovering cellulose from a cellulosic material which contains hemicellulose, cellulose and lignin, which comprises the steps of: contacting the cellulosic material with dilute acid under mild conditions to hydrolyze only the hemicellulose portion thereof;

removing the hydrolyzed hemicellulose portion from the remainder of the cellulosic material residue, said residue being in solid form;

blending and mixing said residue with concentrated sulfuric acid under mild conditions to dissolve and partially hydrolyze the cellulose portion of said residue, the lignin portion being substantially unaffected by the mild reaction conditions and remaining as a solid; and reprecipitating the dissolved and partially hydrolyzed cellulose by adding a reprecipitating agent to the reaction mass resulting from said blending and mixing step, said reprecipitating agent being a member selected from the group consisting of water, water soluble organic solvents and mixtures thereof.

2. The process of claim 1 wherein said dilute acid is sulfuric acid.

3. The process of claim 2 wherein said concentrated sulfuric acid has the strength of about 60 to 90% by weight.

4. The process of claim 2 wherein said blending and mixing of said residue in said concentrated sulfuric acid is performed at about room temperature.

5. The process of claim 1 wherein said reprecipitating agent is water and about 2 to 5 volumes of water are added to the blended reaction mass to reprecipitate said cellulose.

6. The process of claim 1 wherein said reprecipitating agent is methanol.

7. The process of claim 5 wherein about 97% by weight of the cellulose in the cellulosic material is reprecipitated in solid form.

8. The process of claim 1 wherein said concentrated acid is recovered after addition of said reprecipitating agent thereto.

9. The process of claim 8 wherein at least a portion of the recovered acid is recycled.

10. The process of claim 9 wherein about 90% or more of said recovered acid is recycled.

11. The process of claim 1 wherein said reprecipitated cellulose has a lowered DP and has its internal structure and lignin seal disrupted whereby said cellulose may be readily substantially completely hydrolyzed to yield glucose.

12. The process of claim 11 further comprising the step of hydrolyzing said reprecipitated cellulose to glucose by means of cellulase enzymes or a dilute acid or a mixture of a dilute acid and enzymes.

13. A process for recovering cellulose from a cellulosic material which includes hemicellulose, cellulose and lignin, said process comprising:

hydrolyzing the cellulosic material with dilute sulfuric acid to remove the hemicellulose portion of the cellulosic material in the form of a liquid hydrolysate;

separating solid residue including the cellulose and lignin portions of the cellulosic material from said liquid hydrolysate;

adding from about 0.2 to about 5 ml/gm of concentrated sulfuric acid having a strength of between about 60% to 90% by weight to said solid residue to dissolve and partially hydrolyze the cellulose therein;

blending and mixing said solid residue and said concentrated sulfuric acid at about room temperature; and reprecipitating the cellulose from said concentrated sulfuric acid by addition of from about 0.5 to about 5 ml of a reprecipitating agent per ml of said concentrated sulfuric acid, said reprecipitating agent being selected from the group consisting of water or a water soluble organic solvent.

14. A process for providing a high yield of glucose from cellulose recovered from a cellulosic material, said process comprising:

hydrolyzing a cellulosic material with dilute sulfuric acid to remove hemicellulose therefrom as a liquid hydrolysate;

separating a solid residue from said liquid hydrolysate;

adding concentrated sulfuric acid to said residue under mild conditions to dissolve and partially hydrolyze the cellulose therein without degrading the lignin therein;

blending and mixing said residue in said concentrated sulfuric acid under mild reaction conditions;

reprecipitating said dissolved cellulose by diluting said sulfuric acid with water or a water soluble organic solvent; and hydrolyzing said reprecipitated cellulose by exposure to cellulase enzymes and/or a dilute acid to yield glucose therefrom.

15. A process according to claim 14 in which said hydrolysis is achieved by exposing said cellulose to a combination of dilute acid and cellulase enzymes.

16. A process for recovering cellulose from cellulosic materials, said process comprising:

hydrolyzing cellulosic materials with dilute sulfuric acid to remove hemicellulose therefrom in the form of a liquid hydrolysate;

separating a solid residue including cellulose and lignin from said liquid hemicellulose hydrolysate;

washing said solid residue and removing the washing liquid therefrom;

adding concentrated sulfuric acid having a strength of between about 60% to 90% to said solid residue to dissolve and partially hydrolyze the cellulose therein; said concentrated sulfuric acid being added in an amount of from about 0.2 to about 5 ml per gm of said solid residue;

blending and mixing said solid residue in said concentrated sulfuric acid under mild reaction conditions to substantially avoid the formation of any undesirable degradation products; and reprecipitating the dissolved and partially hydrolyzed cellulose by addition of from about 0.5 to 5 volumes of a reprecipitating agent per volume of said concentrated sulfuric acid.

17. The process of claim 1 wherein the dissolved and partially hydrolyzed cellulose is separated from the solid lignin portion of the cellulosic material before the cellulose is reprecipitated.

18. The process of claim 1 wherein said reprecipitating agent is water.

19. The process of claim 13 wherein said reprecipitating agent is water.

* * * * *